US011145273B2

(12) United States Patent
Uchiyama

(10) Patent No.: US 11,145,273 B2
(45) Date of Patent: Oct. 12, 2021

(54) METHOD OF CONTROLLING DISPLAY DEVICE, AND DISPLAY DEVICE

(71) Applicant: SEIKO EPSON CORPORATION, Tokyo (JP)

(72) Inventor: Yoshiteru Uchiyama, Suwa (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/896,292

(22) Filed: Jun. 9, 2020

(65) Prior Publication Data

US 2020/0388241 A1 Dec. 10, 2020

(30) Foreign Application Priority Data

Jun. 10, 2019 (JP) ..... JP2019-107732

(51) Int. Cl.
*G09G 5/00* (2006.01)

(52) U.S. Cl.
CPC ..... *G09G 5/006* (2013.01); *G09G 2354/00* (2013.01); *G09G 2370/08* (2013.01); *G09G 2370/20* (2013.01)

(58) Field of Classification Search
CPC ..... G09G 5/006; G09G 2354/00; G09G 2370/20; G09G 2370/08; G06F 3/1407; G06F 3/04817; G06F 9/451
See application file for complete search history.

(56) References Cited

U.S. PATENT DOCUMENTS

2005/0200811 A1* 9/2005 Nobori ..... H04N 9/31 353/15
2006/0230360 A1* 10/2006 Young ..... H04N 21/4622 715/781
2016/0019860 A1* 1/2016 Maeda ..... H04N 21/4424 345/520
2017/0255350 A1* 9/2017 Yu ..... G06F 3/04817

FOREIGN PATENT DOCUMENTS

JP 2005-258291 A 9/2005
JP 2011-128257 A 6/2011

* cited by examiner

*Primary Examiner* — Brent D Castiaux
(74) *Attorney, Agent, or Firm* — Oliff PLC

(57) ABSTRACT

A control method including home screen display step of making display section display a home screen where identification images representing the respective input interfaces are displayed in respective display areas so as to correspond one-to-one when image information is not input to N input interfaces provided to the display device, determination step of determining whether one of the input interfaces has changed to state in which the image information is input, identification step of identifying display area having the highest priority representing an order of displaying image out of the display areas where the identification images are currently displayed when the determination result is affirmative, and home screen information update step of displaying image input to input interface in display area thus identified, and displaying the identification images of the input interfaces in the state in which the image information is not input in the display areas lower in priority.

6 Claims, 8 Drawing Sheets

FIG. 3

D1

| NUMBER | IDENTIFICATION INFORMATION |
|---|---|
| 1 | HDMI1 |
| 2 | HDMI2 |
| 3 | HDMI3 |
| 4 | Computer |
| 5 | ScreenMirrorring |
| 6 | WI-FI |
| 7 | USB |
| 8 | HDBaseT |

METHOD OF CONTROLLING DISPLAY DEVICE, AND DISPLAY DEVICE

The present application is based on, and claims priority from JP Application Serial Number 2019-107732, filed Jun. 10, 2019, the disclosure of which is hereby incorporated by reference herein in its entirety.

BACKGROUND

1. Technical Field

The present disclosure relates to a method of controlling a display device and a display device.

2. Related Art

As an example of the display device, there can be cited a projector for projecting an image represented by image information input to an input interface including an input terminal and the like on a screen. In JP-A-2005-258291, there is disclosed a display device for performing preview display of the images represented by the image information in the process of input in an input terminal catalog.

In recent years, display devices are each provided with a number of input interfaces. When the number of the input interfaces becomes large, there is a problem that it becomes difficult for the user to figure out the change in input state such as a start or a stop of input of the image information even when performing the preview display of the images represented by the image information which is inputting to the input interfaces in the input terminal catalog.

SUMMARY

A method of controlling a display device according to the present disclosure is a method of controlling a display device provided with N (N is an integer not smaller than 2) input interfaces configured to input image information and a display section configured to display a display image on a display surface, the method including the steps of making the display section display N identification images used to identify each of the N input interfaces in N display areas disposed in the display image so as to correspond one-to-one to each other in a state in which the image information is not input to any of the N input interfaces, determining whether or not a change from the state in which the image information is not input to one of the N input interfaces to a state in which the image information is input to the one of the N input interfaces occurred, identifying one display area highest in priority from one or more display areas where the identification images are currently displayed out of the N display areas in accordance with the priority representing an order of displaying the image information determined in advance to the N display areas when a result of the determination is affirmative, making the display section display an image based on the image information input to the one input interface in the one display area when the result of the determination is affirmative, and making the display section display the one or more identification images in the one or more display areas lower in priority than the one display area so as to correspond one-to-one to each other when the result of the determination is affirmative, wherein the one or more identification images correspond one-to-one to the one or more input interfaces to which the image information is not input.

A method of controlling a display device according to the present disclosure is a method of controlling a display device provided with N (N is an integer not smaller than 2) input interfaces configured to input image information and a display section configured to display a display image on a display surface, the method including the steps of displaying K images respectively represented by K ($1 \leq K \leq N$) pieces of image information in K display areas high in priority representing orders of displaying predetermined image information so as to correspond one-to-one to each other out of the N display areas provided to the display image in a state in which the image information is input to K input interfaces out of the N input interfaces, determining whether or not a change from a state in which the image information is input to a state in which the image information is not input occurred in one input interface corresponding the display area having j-th ($1 \leq j < K$) priority out of the K display areas, displaying one or more images to be displayed in one or more display areas having the j+1-th through K-th priorities so as to correspond one-to-one to each other in one or more display areas having the j-th through K−1-th priorities so as to correspond one-to-one to each other when a result of the determination is affirmative, and displaying an identification image corresponding to the one input interface in one or one of more display areas having the K-th through N-th priorities when the result of the determination is affirmative.

A display device according to the present disclosure includes a display section configured to display a display image on a display surface, N (N is an integer not smaller than 2) input interfaces configured to input image information representing an image to be displayed on the display surface, a display control section configured to make the display section display N identification images used to identify each of the N input interfaces in N display areas disposed in the display image so as to correspond one-to-one to each other in a state in which the image information is not input to any of the N input interfaces, a determination section configured to determine whether or not a change from the state in which the image information is not input to one of the N input interfaces to a state in which the image information is input to the one of the N input interfaces occurred, and an identification section configured to identify one display area highest in priority from one or more display areas where the identification images are currently displayed out of the N display areas in accordance with the priority representing an order of displaying the image information determined in advance to the N display areas when a result of the determination is affirmative, wherein the display control section makes the display section display the image based on the image information input to the one input interface in the one display area, and the one or more identification images in the one or more display areas lower in priority than the one display area so as to correspond one-to-one to each other, and the one or more identification images correspond one-to-one to the one or more input interfaces to which the image information is not input.

BRIEF DESCRIPTION OF THE DRAWINGS

FIG. 3 is a diagram showing an example of contents of an I/F management information stored in a storage section of the display device.

DESCRIPTION OF AN EXEMPLARY EMBODIMENT

An embodiment will hereinafter be described with reference to the drawings. It should be noted that in each of the drawings, the size and the scale of each of the constituents are arbitrarily made different from actual ones. Further, the embodiment described hereinafter is added with a variety of technically preferable limitations, but the embodiment is not limited to these aspects.

1. General Description of Display System

Figure 1:
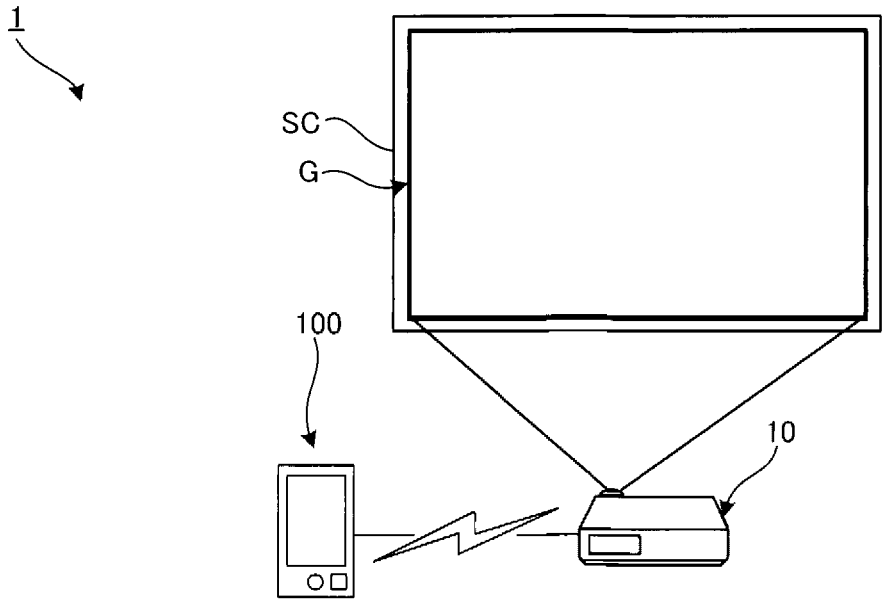
FIG. 1 is a schematic diagram showing an appearance of a display system including a display device according to an embodiment of the present disclosure.

FIG. 1 is a diagram schematically showing an appearance of a display system 1 according to the embodiment of the present disclosure. The display system 1 is a projection system. As shown in FIG. 1, the display system 1 is provided with a display device 10 and a terminal device 100. The display device 10 is, for example, a projector. The terminal device 100 is a device for providing the display device 10 with a variety of instructions, and corresponds to a so-called remote controller. The terminal device 100 is, for example, a smartphone, and is coupled to the display device 10 so as to be able to communicate with each other. The coupling can be achieved wirelessly or with wire. The terminal device 100 in the present embodiment is a smartphone, but can also be, for example, a desktop personal computer, a notebook personal computer, or a tablet terminal. The terminal device 100 has no particular difference from a general smartphone, and therefore, the detailed description thereof will be omitted, and the description will hereinafter be provided with a focus on the display device 10.

Although not shown in FIG. 1, to the display device 10, there is coupled an external device for supplying the display device 10 with image information so as to be able to communicate with each other in addition to the terminal device 100. As a specific example of the external device to be coupled to the display device 10, there can be cited a personal computer, a DVD (Digital Versatile Disk) player, and so on. To the display device 10, there can be coupled up to N (N is an integer not smaller than 2) external devices.

The display device 10 projects an image G based on the image information from one external device coupled to the display device 10, or an image G based on the image information from any one of external devices coupled to the display device 10 on a screen SC. Thus, the display of the image G by the display device 10 is achieved. As the installation place of the screen SC, there can be cited, for example, a wall, a floor, and a table. Further, as the installation place of the display device 10, there can be cited, for example, the ceiling, the wall, the floor, the table, and a dedicated installation stand.

The user of the display device 10 can change the settings of the display device 10 by an operation to the terminal device 100. The settings are not particularly limited, but as the settings, there can be cited, for example, image quality settings such as brightness, contrast, and depth of colors, picture settings such as input resolution, an aspect ratio, and a display position, and other settings such as a geometric distortion correction, a zoom setting, and sound volume. Although the details will be described later, the display device 10 is capable of displaying an image of a home screen for allowing the user to designate an image to be projected on the screen SC in addition to the image represented by the image information supplied from the external device. The user of the display device 10 can select an image to be projected on the screen SC by an operation to the terminal device 100.

2. Configuration of Display Device

Figure 2:
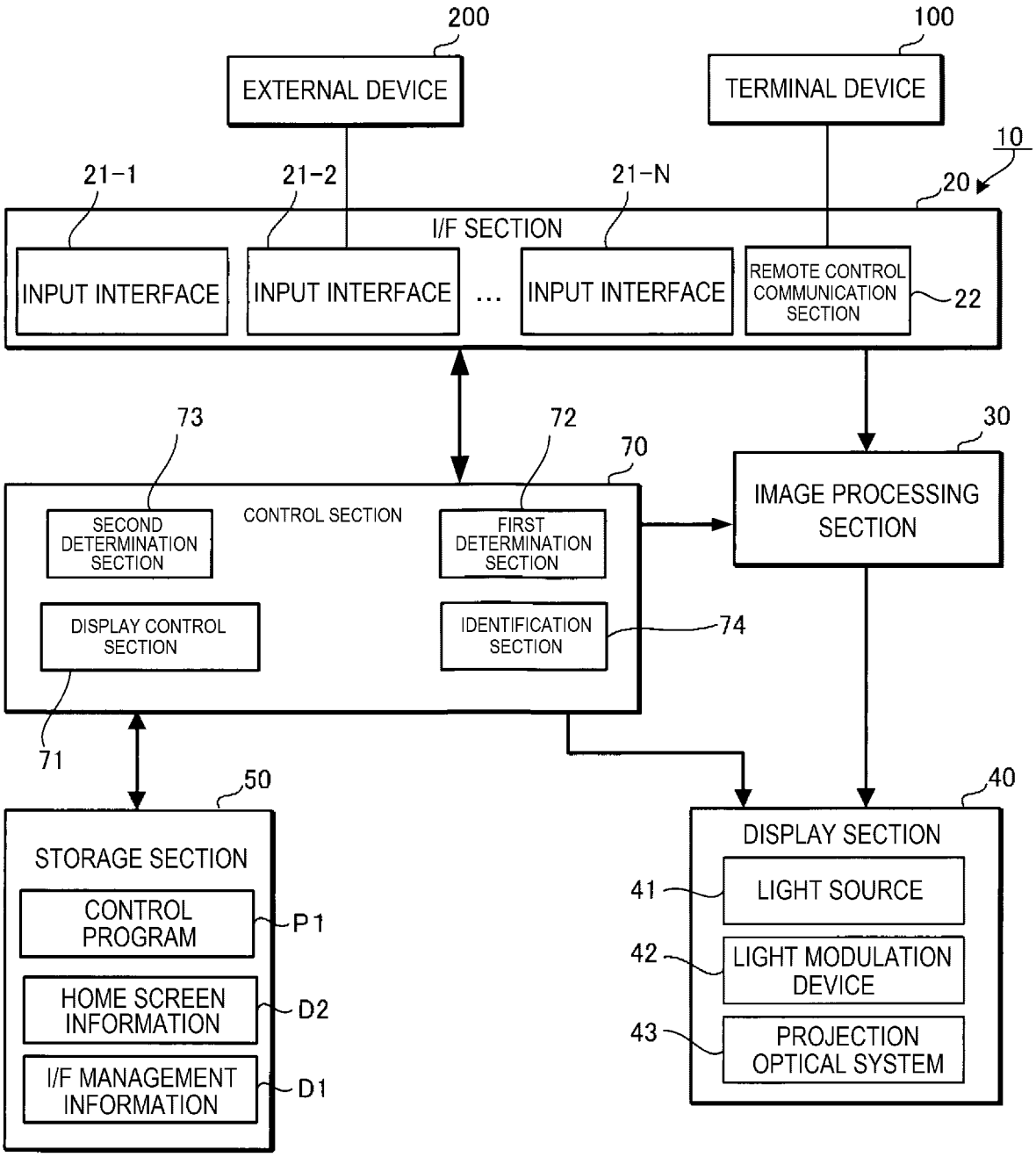
FIG. 2 is a block diagram showing a hardware configuration example and a functional configuration example of the display device.

FIG. 2 is a block diagram showing a hardware configuration example and a functional configuration example of the display device 10. As shown in FIG. 2, the display device 10 has an I/F (interface) section 20, an image processing section 30, a display section 40, a storage section 50, and a control section 70.

The I/F section 20 is provided with input interfaces 21-1, 21-2, . . . , 21-N and a remote control communication section 22. Each of the input interfaces 21-1 through 21-N has a function of inputting the image information to the display device 10. To each of the input interfaces 21-1 through 21-N, there is coupled an external device for supplying the display device 10 with the image information. In FIG. 2, there is illustrated when the external device 200 is coupled only to the input interface 21-2 out of the input interfaces 21-1 through 21-N. In the present embodiment, numbers i are assigned in advance respectively to the input interfaces 21-*i* (1N). In other words, the input interfaces 21-1 through 21-N are the first through N-th input interfaces, respectively. The input interfaces 21-1 through 21-N are each hereinafter described as an input interface 21 unless the input interfaces 21-1 through 21-N need to be distinguished from each other.

Each of the N input interfaces 21 is, for example, a D-sub or HDMI interface. It should be noted that the standards of the N input interfaces 21 can be the same as each other, or can also be different from each other. The input interface 21 is only required to input the image information from the external device, and can be a wireless communication interface such as Wi-Fi or Bluetooth, or can also be a wired communication interface such as USB or LAN (Local Area Network). HDMI, Wi-Fi, and Bluetooth are each a registered trademark. Hereinafter, in the present embodiment, there will be described when N=8 is assumed, the input interfaces 21-1 through 21-3 are compliant with HDMI, the input interface 21-4 is compliant with Computer, the input interface 21-5 is compliant with ScreenMirroring, the input interface 21-6 is compliant with Wi-Fi, the input interface 21-7 is compliant with USB, and the input interface 21-8 is compliant with HGBaseT.

The remote control communication section 22 can be coupled to the terminal device 100 using wireless communication. Specifically, the remote control communication section 22 is a wireless communication interface such as Wi-Fi or Bluetooth. It should be noted that when providing the display device 10 with an operation section having a variety of operators for allowing the user to make a variety of types of settings, the remote control communication section 22 can be eliminated. Further, it is also possible to use the wireless communication interface or the wired communication interface out of the N input interfaces 21 as the remote control communication section 22, and in this case, it is not necessary to provide the remote control communication section 22 separately from the N input interfaces 21.

The image processing section 30 is a circuit for performing a variety of types of image processing on the image information provided from the I/F section 20 or the image information provided from the control section 70 to generate display information, and then inputting the display information thus generated to the display section 40. The image processing section 30 has, for example, a frame memory not shown. The image processing section 30 develops the image information provided from the I/F section 20 or the image information provided from the control section 70 on the frame memory, then performs a variety of types of processing such as a resolution conversion process, a resizing process, and a distortion correction process as needed to generate the display information, and then inputs the display information thus generated to the display section 40.

The display section 40 is a projection device for projecting image light on the screen Sc as a display surface to thereby display the image G. The display section 40 has a light source 41, a light modulation device 42, and a projection optical system 43.

The light source 41 is configured including, for example, a halogen lamp, a xenon lamp, a super-high pressure mercury lamp, an LED (Light Emitting Diode), or a laser light source. The light source 41, for example, emits red light, green light, and blue light separately from each other, or emits white light. When the light source 41 emits the white light, the light emitted from the light source 41 is reduced in unevenness of the luminance distribution due to an integrator optical system not shown, and is then separated by a color separation optical system not shown into the red light, the green light, and the blue light, and then enters the light modulation device 42. The light modulation device 42 is configured including three light modulation elements provided so as to correspond to the red light, the green light, and the blue light. The three light modulation elements are each configured including, for example, a transmissive liquid crystal panel, a reflective liquid crystal panel, or a digital mirror device. The three light modulation elements respectively modulate the red light, the green light, and the blue light to generate the image light of the respective colors. The image light beams of the respective colors generated in the light modulation device 42 are combined by a color combining optical system to turn to full-color image light. The projection optical system 43 images to project the full-color image light on the screen SC. The projection optical system 43 is an optical system including at least one projection lens, and can also include a zoom lens, a focus lens, or the like.

The storage section 50 is a storage device for storing I/F management information D1, home screen information D2, and a control program P1 to be executed by the control section 70. Although the details will be described later, the I/F management information D1 and the home screen information D2 are information to be referred to or updated by the control section 70 in the process of executing the control program P1. Although the detailed illustration is omitted in FIG. 2, the storage section 50 includes a volatile storage section and a nonvolatile storage section. The volatile storage section means a storage device which cannot keep the information stored unless the power is supplied, and the nonvolatile storage section means a storage device which can keep the information stored even when the power is not supplied. As an example of the volatile storage section, there can be cited a RAM (Random Access Memory). The volatile storage section is used as a work area for storing the information to be processed by the control section 70 and a work area when executing the control program P1. As an example of the nonvolatile storage section, there can be cited a hard disk. In the nonvolatile storage section, there is stored in advance the control program P1, the I/F management information D1, and the home screen information D2. It should be noted that a part or the whole of the storage section 50 can also be provided to an external storage device of the display device 10 or a server.

FIG. 3 is a diagram showing an example of the I/F management information D1. As shown in FIG. 3, the I/F management information D1 makes the number having already been assigned respectively to the N input interfaces 21 and N pieces of identification information respectively representing the input interfaces 21-1 through 21-N correspond one-to-one to each other. The N pieces of identification information correspond one-to-one to the N input interfaces 21. The N pieces of identification information each represent an identification image for identifying the input interface 21. Although icons are illustrated as the identification images in the present embodiment, the identification images can also be images of characters representing the names of the input interfaces 21.

Figure 4:
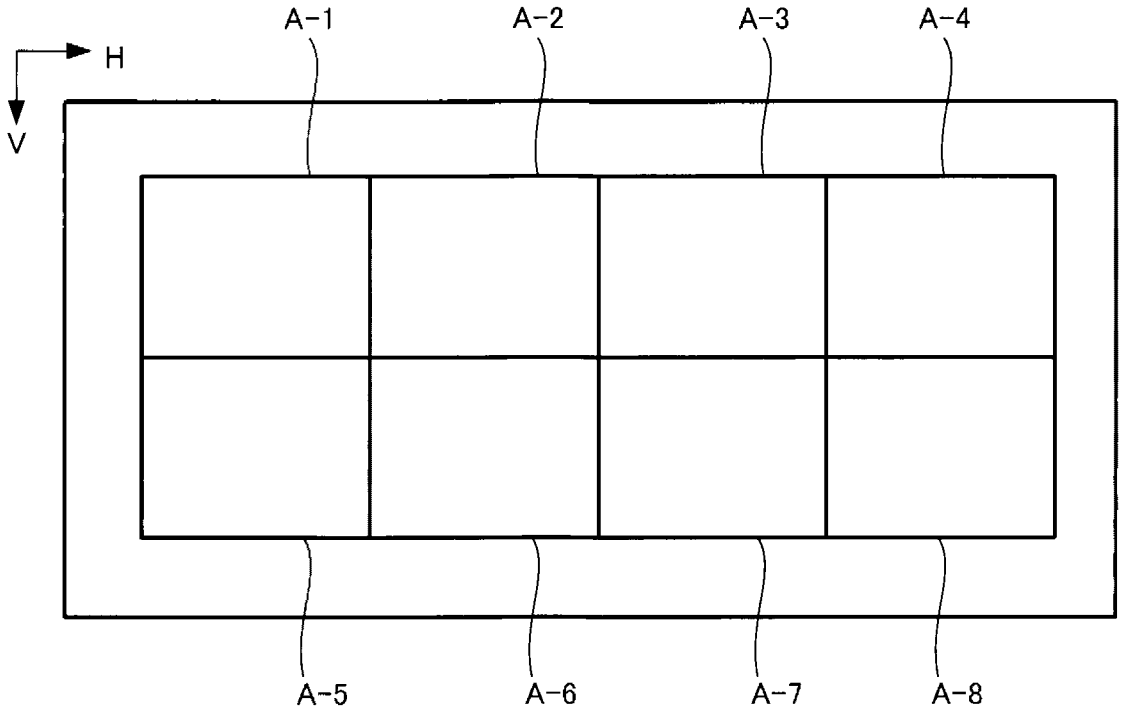
FIG. 4 is a diagram showing an example of a screen layout of a home screen which a control section makes a display section display in accordance with home screen information stored in the storage section of the display device.

The home screen information D2 is information for defining the screen layout of the home screen. In the home screen information D2, there are included information representing the display position of the home screen, information representing the size of the home screen in the horizontal scanning direction and the vertical scanning direction, the number, the positions, and the sizes of the display areas provided to the home screen, information representing an image to be displayed in the display area, information representing a display color of a part other than the display area, and so on. Although the details will be described later, the control section 70 retrieves the home screen information D2 from the nonvolatile storage section into the volatile storage section to display the home screen in accordance with the home screen information D2 having already been retrieved in the volatile storage section. FIG. 4 is a diagram showing an example of the screen layout of the home screen represented by the home screen information D2. As shown in FIG. 4, in the home screen in the present embodiment, there are disposed the same number of display areas as the number of the input interfaces 21, namely the display areas A-1 through A-N. As shown in FIG. 4, in the home screen in the present embodiment, there are disposed totally eight display areas arranged in four columns in the horizontal scanning direction H and two rows in the vertical scanning direction V. The display areas A-1 through A-N are each hereinafter described as a display area A unless the display areas A-1 through A-N need to be distinguished from each other. In the home screen information D2, as the information representing the display image of the display area A-i, there is included the identification information representing the icon representing the i-th input interface 21-*i* as an initial value.

The display area A is a display area for displaying the identification image representing the input interface 21, or an image based on the image information input to the input interface 21. The image based on the image information input to the input interface 21 means a thumbnail image which can be obtained by contracting the image represented by the image information. The thumbnail image can be a still image, or can also be a moving image. When the thumbnail image is a moving image, the thumbnail image can be obtained by contracting the image represented by the image information. When the thumbnail image is a still image, the thumbnail image can be obtained by contracting and then capturing the image represented by the image information. When the thumbnail image is a moving image, the processing load increases. Therefore, when the thumbnail image is a moving image, it is possible to lower the frame rate of the image information to generate the thumbnail image.

To the display areas A-1 through A-N, there is decided in advance the ordering of priority representing the orders of displaying the images based on the image information in accordance with the display positions of the respective display areas. Specifically, regarding the four display areas A belonging to a single row, the ordering of priority is decided so that the orders of displaying the image information descend in the direction from the left side to the right side, namely along the horizontal scanning direction H. Further, in the two rows different from each other, the ordering of priority is decided so that the order of the display area A on the left end in the lower row becomes lower than the order of the display area A located at the right end in the upper row. In other words, in the home screen having the screen layout shown in FIG. 4, the priority of the display area A-1 is the highest, and the ordering priority descends along the orders of the display areas A-2, A-3, A-4, A-5, A-6, A-7, and A-8. The reason that the ordering priority is decided in such a manner is that there is considered the fact that those having a language such as Japanese or English in which a sentence is written left to right and top to bottom as a mother tongue are apt to direct attention to the upper left corner as the starting point of the sentence. When the user is a person having a language such as Arabic in which a sentence is written right to left as a mother tongue, it is possible to decide the ordering priority so that the orders of displaying the image information descend along a direction from the right side toward the left side with respect to the four display areas A belonging to a single row.

The control section 70 is a processing device having a function of controlling each section of the display device and a function of processing a variety of types of information. The control section 70 is configured including a processor such as a CPU (Central Processing Unit). The control section 70 executes the control program P1 stored in the storage section 50 to thereby realize a variety of functions including functional sections described later. It should be noted that the control section 70 can be formed of a single processor, or can also be constituted by a plurality of processors. Further, some or all of the functions of the control section 70 can also be realized by hardware such as a DSP (Digital Signal Processor), an ASIC (Application Specific Integrated Circuit), a PLD (Programmable Logic Device), or an FPGA (Field Programmable Gate Array). Further, the control section 70 can be integrated with the image processing section 30 described above.

As shown in FIG. 2, the control section 70 retrieves the control program P1 from the storage section 50 and then executes the control program P1 to thereby function as a display control section 71, a first determination section 72, a second determination section 73, and an identification section 74.

Figure 5:
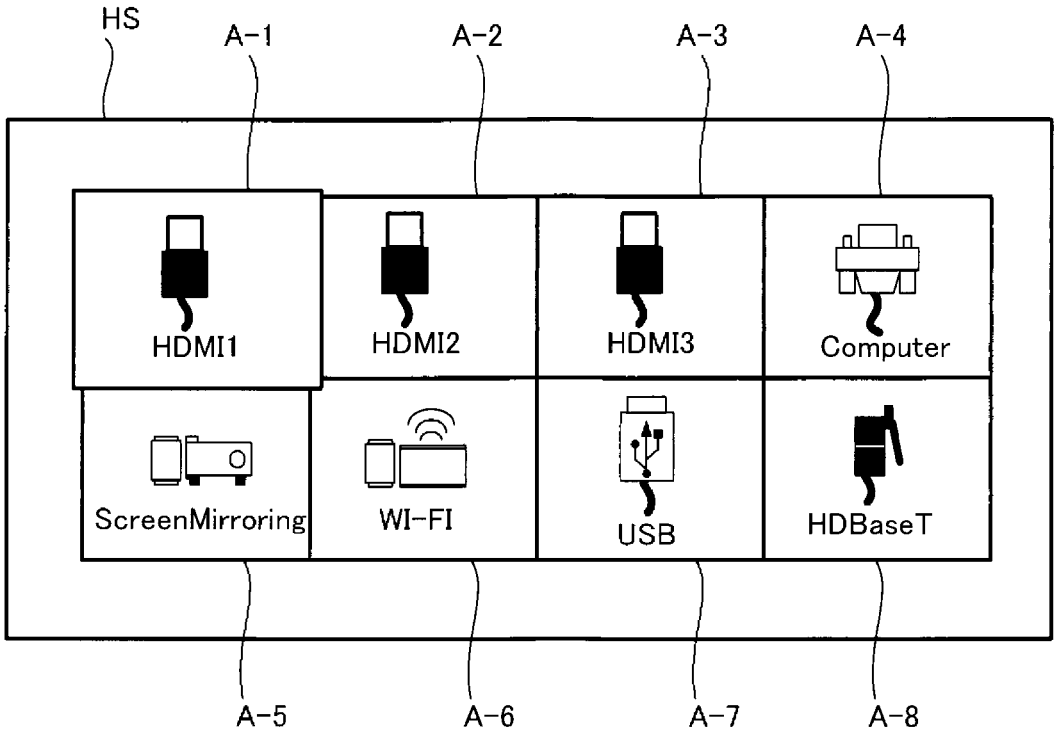
FIG. 5 is a diagram showing an example of a home screen to be displayed by the display device.

The display control section 71 retrieves the home screen information D2 from the nonvolatile storage section in the volatile storage section when starting the execution of the control program P1. Then, the display control section 71 generates the image information for making the display section 40 display the home screen in accordance with the home screen information D2 which has already been retrieved in the volatile storage section, and then provides the image information thus generated to the image processing section 30. On this occasion, the display control section 71 positions a cursor for allowing the user to designate the image information in the display area A having the highest priority of the home screen, and generates the image information representing the home screen in which the display area A is magnified at a predetermined magnification ratio in order to clearly show the fact that the cursor is positioned. In the initial state in which the image information is input to none of the N input interfaces 21, the home screen is displayed in accordance with the initial value of the home screen information DS2. As described above, in the home screen information D2, as the information representing the display image of the display area A-i, there is included the identification information representing the icon representing the i-th input interface 21 as the initial value. Therefore, in the initial state, as shown in FIG. 5, the display section 40 displays the home screen HS in which N identification images for identifying each of the N input interfaces 21 are assigned corresponding one-to-one to the N display areas A, namely the home screen HS in which the icon of the i-th input interface 21 is assigned to the display area A-i.

Further, in response to the fact that the input state of the image information has been changed from a non-input state to the input state with respect to any one of the N input interfaces 21 as a trigger, the display control section 71 updates the home screen information D2 of the volatile storage section in accordance with the change thereof, and makes the display section 40 display the home screen again in accordance with the home screen information D2 having been updated. Thus, the home screen is updated in accordance with the change in the input state of the N input interfaces 21. Although the details will be described later, in the state in which the image information is input to K ($1 \leq K \leq N$) input interfaces out of the N input interfaces 21, the display control section 71 makes the display section 40 display the home screen in which K images respectively represented by K pieces of image information are assigned so as to correspond one-to-one to the K display areas A high in priority representing the orders of displaying the predetermined image information out of the N display areas A.

The first determination section 72 monitors the input of the image information from the external device corresponding to each of the N input interfaces 21 to determine whether or not the state of the input of the image information to any one of the input interfaces 21 has changed from the non-input state to the input state.

When the determination result by the first determination section 72 is affirmative, the identification section 74 identifies the highest one in priority of the one or more display areas A where the identification images are currently displayed out of the N display areas A in accordance with the priorities decided in advance to the N display areas A.

When the determination result by the first determination section 72 is affirmative, the display control section 71 updates the home screen information D2 in the volatile storage section so that the image based on the image information input to the input interface 21 which has been determined by the first determination section 72 that the change from the non-input state to the input state has occurred is displayed in the display area A which has already been identified by the identification section 74. Specifically, the display control section 71 firstly generate the thumbnail image information for displaying the thumbnail image from the image information input to the input interface 21 having already been determined. Subsequently, the display control section 71 updates the information representing the display image in the display area A having already been identified as described above in the home screen information D2 in the volatile storage section with the thumbnail image information described above.

Further, the display control section 71 updates the home screen information D2 in the volatile storage section so that the identification image or the identification images respectively representing the one or more input interfaces 21 in the state in which the image information is not input are displayed so as to correspond one-to-one to the one or more display areas A lower in priority than the display area A having already been identified by the identification section 74. In the more specific description, the display control section 71 updates the information representing the display image in the display area with the identification information of the input interface 21 which has not been assigned to the display area A, and which has the youngest number out of the one or more input interfaces 21 to which the image information has not been input in the descending order of the priority with respect to the one or more display areas lower in priority then the display area A having already been identified by the identification section 74.

The second determination section 73 determines whether or not a change from the input state to the non-input state of the image information has occurred with respect to one input interface corresponding to the display area having the j-th ($1 \leq j \leq K$) priority out of the K display areas in the state in which the image information is input to K input interfaces out of the N input interfaces 21.

When the determination result by the second determination section 73 is affirmative, the display control section 71 updates the home screen information D2 in the volatile storage section so that the one or more images displayed in the one or more display areas A having the j+1-th through K-th priorities so as to correspond one-to-one to each other are displayed in the one or more display areas A having the j-th through K−1-th priorities so as to correspond one-to-one to each other. Further, when the determination result by the second determination section 73 is affirmative, the display control section 71 updates the home screen information D2 in the volatile storage section so that the identification image corresponding to the input interface 21 having already been determined by the second determination section 73 that the change from the input state to the non-input state has occurred is displayed in one or one of more display areas A having the K-th through N-th priorities. Specifically, the display control section 71 firstly refers to the I/F management information D1 to identify the identification information of the input interface 21 having already been determined by the second determination section 73 that the state of input of the image information has been changed from the input state to the non-input state. Subsequently, the display control section 71 updates the information representing the display image in the display area A having the K-th priority in the home screen information D2 in the volatile storage section with the identification information having already been identified as described above.

Figure 6:
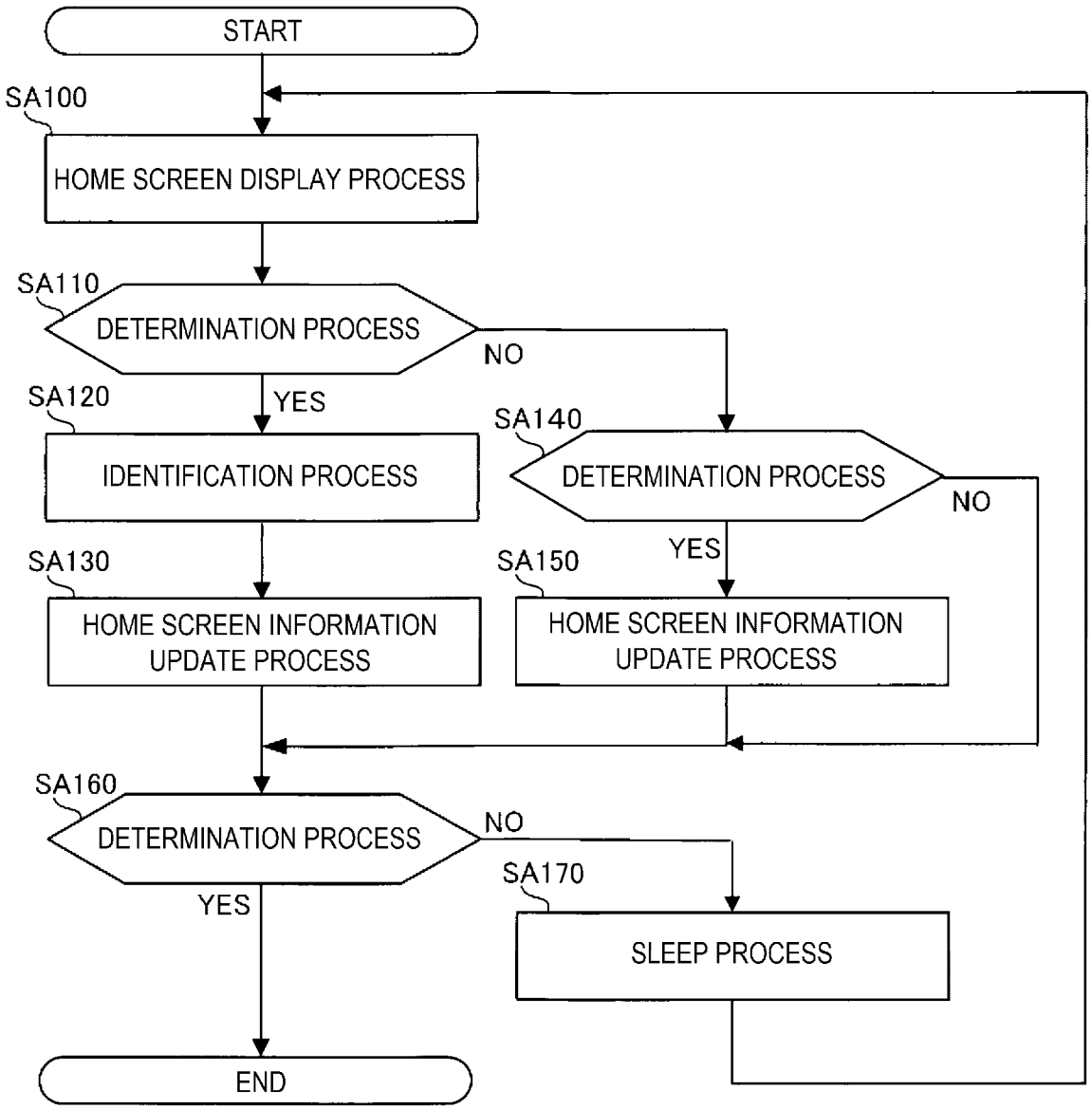
FIG. 6 is a flowchart showing a flow of a control method to be executed by the control section of the display device in accordance with a control program.

In the display device 10 according to the present embodiment, the control section 70 retrieves the control program P1 from the nonvolatile storage section in the volatile storage section in response to power-on or reset of the display device 10 not shown as a trigger, and then starts to execute the control program P1. The control section 70 operating in accordance with the control program P1 retrieves the home screen information D2 from the nonvolatile storage section in the volatile storage section to execute the control method shown in the flowchart in FIG. 6. As shown in FIG. 6, the control method to be executed in the display device 10 includes a home screen display process SA100, a determination process SA110, an identification process SA120, a home screen information update process SA130, a determination process SA140, a home screen information update process SA150, a determination process SA160, and a sleep process SA170.

In the home screen display process SA100, the control section 70 functions as the display control section 71, and makes the display section 40 display the home screen in accordance with the home screen information D2 in the volatile storage section. As described above, the home screen information D2 in the initial state includes the identification information representing each of the N input interfaces 21. Therefore, in the home screen display process SA100 in the initial state, as shown in FIG. 5, there is displayed the home screen HS in which the N identification images for respectively identifying the N input interfaces 21 are assigned to the N display areas A so as to correspond one-to-one to each other. In contrast, when the image information is supplied from the external device to any one of the N input interfaces 21, the home screen is displayed in the display section 40 in accordance with the home screen information D2. In this case, the thumbnail image generated based on the image information is displayed in the display area A corresponding to the input interface 21 to which the image information is input.

In the determination process SA110, the control section 70 functions as the first determination section 72, and determines whether or not the change from the non-input state to the input state of the image information has occurred in one of the N input interfaces 21. When the determination result in the determination process SA110 is affirmative, the control section 70 performs the identification process SA120 and the home screen information update process SA130, and then, performs the determination process SA160. In contrast, when the determination result in the determination process SA110 is negative, the control section 70 performs the determination process SA140.

In the identification process SA120, the control section 70 functions as the identification section 74. In the identification process SA120, the control section 70 identifies the highest one in priority of the one or more display areas A where the identification images are currently displayed out of the N display areas A in accordance with the priorities decided in advance to the N display areas A.

In the home screen information update process SA130, the control section 70 functions as the display control section 71. In the home screen information update process SA130, the control section 70 updates the home screen information D2 in the volatile storage section so that the image based on the image information input to the input interface 21 which has been determined in the determination process SA110 that the change from the non-input state to the input state has occurred is displayed in the display area A which has already been identified in the identification process SA120. In addition, in the home screen information update process SA130, the control section 70 updates the home screen information D2 in the volatile storage section so that the identification images of the input interfaces 21 in the non-input state are displayed in the ascending order of the numbers of the input interfaces 21 in the one or more display areas lower in priority than the display area A having already been identified in the identification process SA120 so as to correspond one-to-one to each other.

In the identification process SA140, the control section 70 functions as the second determination section 73. In the determination process SA140, the control section 70 determines whether or not the state of the input of the image information has changed from the input state to the non-input state with respect to one input interface 21 corresponding to the display area A having the j-th (1j<K) priority out of the K display areas A where the images based on the image information are currently displayed. When the determination result in the determination process SA140 is affirmative, the control section 70 performs the home screen information update process SA150, and then, performs the determination process SA160. In contrast, when the determination result in the determination process SA140 is negative, the control section 70 performs the determination process SA160 without performing the home screen information update process SA150.

In the home screen information update process SA150, the control section 70 functions as the display control section 71. In the home screen information update process SA150, the control section 70 updates the home screen information D2 in the volatile storage section so that the one or more images displayed in the one or more display areas A having the j+1-th through K-th priorities so as to correspond one-to-one to each other are displayed in the one or more display areas A having the j-th through K−1-th priorities so as to correspond one-to-one to each other. In addition, in the home screen information update process SA150, the control section 70 updates the home screen information D2 in the volatile storage section so that the identification image corresponding to the input interface 21 which has been determined in the determination process SA140 that the state of the input of the image information has changed from the input state to the non-input state is displayed in the display area A having the K-th priority.

In the determination process SA160, the control section 70 determines whether or not the termination of the display of the home screen has been instructed. Specifically, when the control section 70 has received the display instruction of the image corresponding to the image information from the external device from the terminal device 100 via the remote control communication section 22, the control section 70 determines that the termination of the display of the home screen has been instructed. When the determination result in the determination process SA160 is affirmative, the control section 70 terminates the execution of the control method shown in FIG. 6, and makes the display section 40 display the image which the control section 70 has been instructed to display. When the determination result in the determination process SA160 is negative, the control section 70 performs the sleep process SA170, and then, performs the home screen display process SA100 once again. In the sleep process SA170, the control section 70 stops the process for a predetermined period of time.

The flow of the control method performed in the display device 10 is described hereinabove.

3. Operation of Display Device

Then, the operation of the display device 10 will be described.

Figure 7:
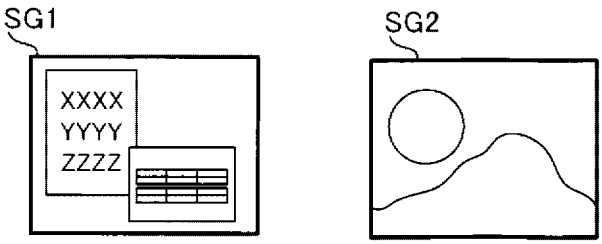
FIG. 7 is a diagram showing an example of an image represented by image information input from an external device to the display device.

The operation example described hereinafter is an operation example when the execution of the control program P1 is started at a time point T0, and the state of the input of the input interfaces 21 changes at subsequent time points T1, T2, and T3 as described below. The period from the time point T0 to the time point T1 corresponds to the initial state in which all of the input interfaces 21 are in the non-input state, and the input of the image information representing the image SG1 shown in FIG. 7 to the input interface 21-2 is started at the time point T1. Subsequently, input of the image information representing the image SG2 shown in FIG. 7 to the input interface 21-4 is started at the time point T2, and further, the input of the image information to the input interface 21-2 is stopped at the subsequent time point T3. It should be noted that the period from the time point T0 to the time point T1, the period from the time point T1 to the time point T2, and the period from the time point T2 to the time point T3 each have a time length sufficiently longer than the stop time of the process in the sleep process SA170. Further, the image SG1 shown in FIG. 7 is an image of a document and a table, and the image SG2 is a scenic image having the moon and a mountain as the objects. Further, in the operation example described hereinafter, the user of the display device 10 does not instruct the termination of the display of the home screen in the period from the time point T0 to the time point T3.

At the time point T0, the display device 10 is in the initial state in which all of the input interfaces 21-1 through 21-N are in the non-input state. Therefore, the control section 70 makes the display section 40 display the home screen HS shown in FIG. 5. Subsequently, the state of the input in each of the N input interfaces 21 does not change until the time point T1 is reached, and therefore, the determination result in the determination process SA110 and the determination process SA140 becomes negative, and the control section 70 performs the determination process SA160. Since in the present operation example, the termination of the display of the home screen is not instructed, the determination result in the determination process SA160 becomes negative, and the control section 70 performs the sleep process SA170. In other words, in the present operation example, the control section 70 repeatedly performs the home screen display process SA100, the determination process SA110, the determination process SA140, the determination process SA160, and the sleep process SA170 until the time point T1 is reached. Since the home screen information D2 in the volatile storage section in the display device 10 is not updated until the time point T1 is reached, the control section 70 continues to make the display section 40 display the home screen HS shown in FIG. 5 until the time point T1 is reached.

In the determination process SA110 performed for the first time after the state of the input in the input interface 21-2 has changed from the non-input state to the input state at the time point T1, the determination result becomes affirmative. Therefore, the control section 70 performs the identification process SA120. At that moment, the identification images are displayed in all of the display areas A-1 through A-N, and the display area A-1 is the highest in priority of the N display areas A. Therefore, the control section 70 identifies the display area A-1 as the one display area. In the home screen information update process SA130 performed subsequently to the identification process SA120, the control section 70 updates the home screen information D2 in the volatile storage section. More specifically, the control section 70 updates the home screen information D2 in the volatile storage section so that the thumbnail image based on the image information input from the input interface 21-2 is displayed in the display area A-1, and the identification images of the input interfaces 21-1, 21-3 through 21-N are displayed in the display areas A-2 through A-N. Subsequently, the control section 70 performs the determination process SA160 and the sleep process SA170.

Figure 8:
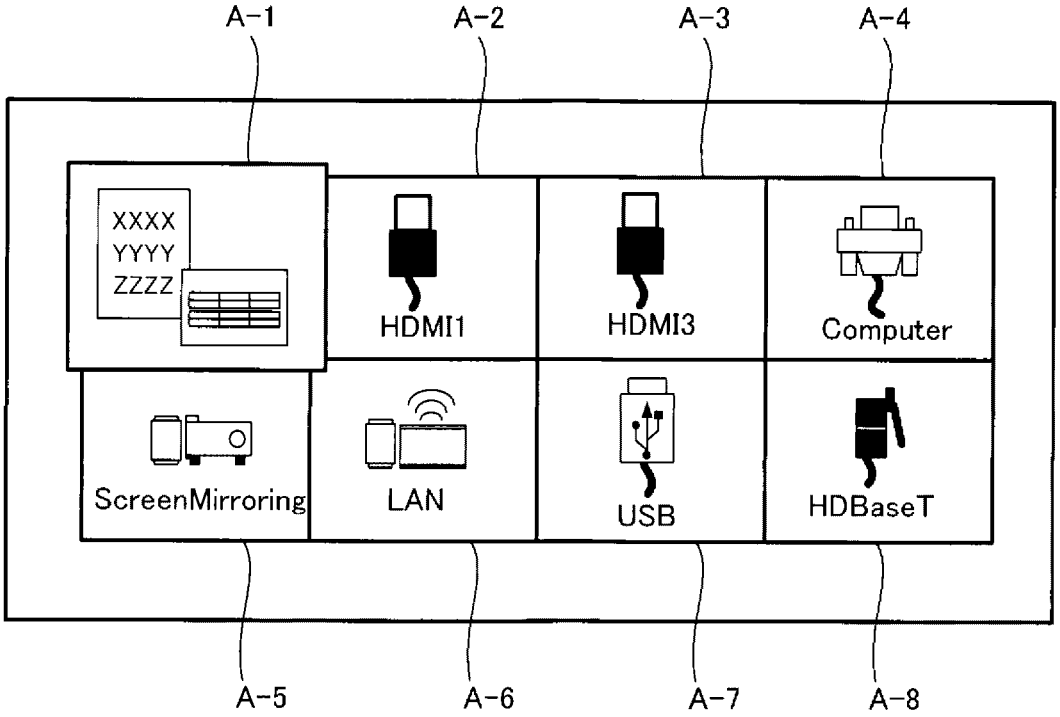
FIG. 8 is a diagram showing an example of the home screen to be displayed by the display device.

In the home screen display process SA100 performed immediately after the update of the home screen information D2, the control section 70 makes the display section 40 display the home screen shown in FIG. 8 in accordance with the home screen information D2 having been updated. Since the state of the input in the N input interfaces 21 does not change until the time point T2 is reached, the control section 70 repeatedly performs the home screen display process SA100, the determination process SA110, the determination process SA140, the determination process SA160, and the sleep process SA170. Since the home screen information D2 in the volatile storage section in the display device 10 is not updated until the time point T2 is reached, the control section 70 continues to make the display section 40 display the home screen HS shown in FIG. 8 until the time point T2 is reached.

In the determination process SA110 performed for the first time after the state of the input in the input interface 21-4 has changed from the non-input state to the input state at the time point T2, the determination result becomes affirmative. Therefore, the control section 70 performs the identification process SA120. At that moment, the identification images are displayed in the display areas A-2 through A-N, and the display area A-2 is the highest in priority of the N-1 display areas A. Therefore, the control section 70 identifies the display area A-2 as the one display area. In the home screen information update process SA130 to be performed subsequently to the identification process SA120, the control section 70 updates the home screen information D2 in the volatile storage section so that the thumbnail image based on the image information input from the input interface 21-4 is displayed in the display area A-2, and the identification images of the input interfaces 21-1, 21-3, 21-5 through 21-N are displayed in the display areas A-3 through A-N.

Figure 9:
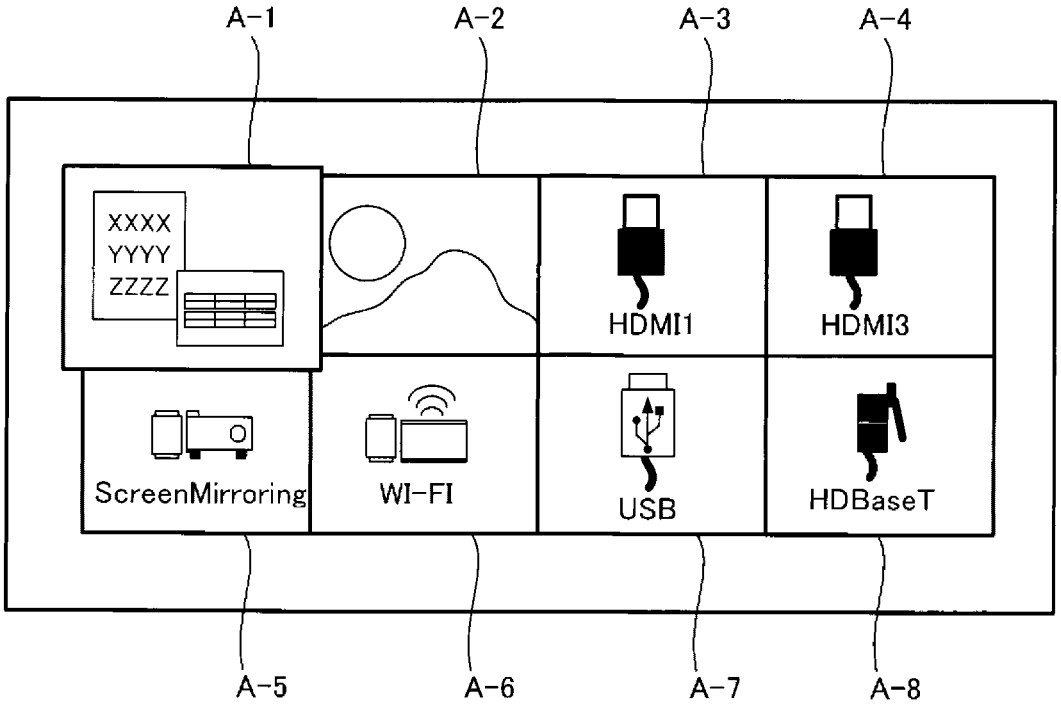
FIG. 9 is a diagram showing an example of the home screen to be displayed by the display device.

In the home screen display process SA100 performed immediately after the update of the home screen information D2, the control section 70 makes the display section 40 display the home screen HS shown in FIG. 9 in accordance with the home screen information D2 having been updated. Since the state of the input in the N input interfaces 21 does not change until the time point T3 is reached, the control section 70 repeatedly performs the home screen display process SA100, the determination process SA110, the determination process SA140, the determination process SA160, and the sleep process SA170. Since the home screen information D2 in the volatile storage section in the display device 10 is not updated until the time point T3 is reached, the control section 70 continues to make the display section 40 display the home screen HS shown in FIG. 9 until the time point T3 is reached.

Figure 10:
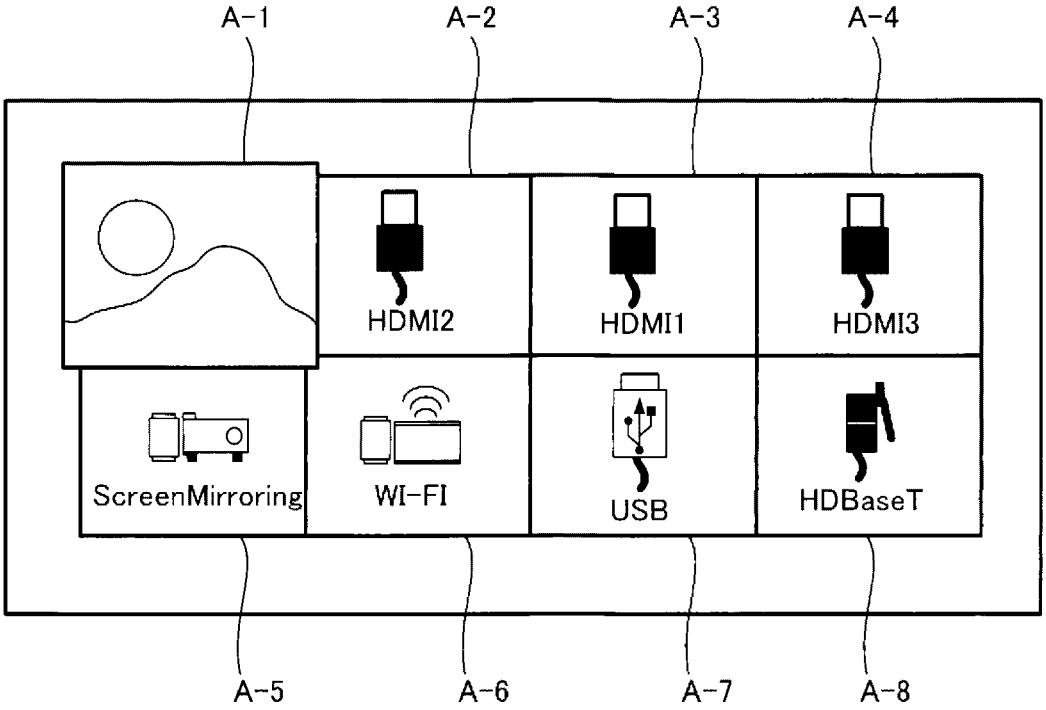
FIG. 10 is a diagram showing an example of the home screen to be displayed by the display device.

In the present operation example, the state of the input in the input interface 21-2 is switched from the input state to the non-input state at the time point T3. This means that the state of the input in the input interface 21-2 associated with the display area A-1 having the first priority out of the two display areas A where the images based on the image information are currently displayed has changed from the input state to the non-input state. Therefore, the determination result in the determination process SA140 performed for the first time after the state of the input in the input interface 21-2 has changed from the input state to the non-input state becomes affirmative, and the control section 70 performs the home screen information update process SA150. In the home screen information update process SA150, the control section 70 updates the home screen information D2 in the volatile storage section so that the image displayed in the display area A-2 having the second priority, namely the image based on the image information from the input interface 21-4, is displayed in the display area A-1 having the first priority, and the identification image corresponding to the input interface 21-2 is displayed in the display area A-2 having the second priority. In the home screen display process SA100 performed immediately after the update of the home screen information D2, the control section 70 makes the display section 40 display the home screen HS shown in FIG. 10 in accordance with the home screen information D2 having been updated.

As described hereinabove, the display device 10 has the display control section 71, the first determination section 72, and the identification section 74. In the state in which the image information is not input in any of the N input interfaces 21, the display control section 71 displays the N identification images for identifying each of the N input interfaces 21 in the N display areas A disposed in the home screen so as to correspond one-to-one to each other. The first determination section 72 determines whether or not the change from the non-input state to the input state of the image information has occurred in one of the N input interfaces 21. When the determination result by the first determination section 72 is affirmative, the identification section 74 identifies the highest one in priority of the one or more display areas where the identification images are currently displayed out of the N display areas in accordance with the priorities representing the orders of displaying the images represented by the predetermined image information to the N display areas. Then, the display control section 71 displays the image based on the image information input to one input interface in one display area. Further, the display control section 71 displays the one or more identification images, namely the identification images for making the user recognize each of the one or more input interfaces to which no image information is input, so as to correspond one-to-one to the one or more display areas lower in priority than the one display area.

In the display device 10, when input of the image information to any one of the N input interfaces 21 is newly started, the determination result by the first determination section 72 becomes affirmative, and the display area as the display destination of the image based on the image information, namely the display area the highest in priority out of the display areas where the identification images are currently displayed, is identified by the identification section 74. Then, the display control section 71 displays the image based on the image information which has newly started to be input in the display area having already been identified by the identification section 74. In the display device 10 according to the present embodiment, every time the input of the image information to any one of the N input interfaces 21 is newly started, the image based on that image information is displayed in the display area the highest in priority out of the display areas where the identification images are displayed at that moment. In the present embodiment, since the more likely the user directs attention toward the display area, the higher the priority of the display area is decided, it becomes easy to figure out the image which has the most recently started to be input.

Further, the display device 10 has the display control section 71 and the second determination section 73. In the state in which the image information is input to the K input interfaces out of the N input interfaces 21, the display control section 71 displays the K images respectively represented by the K pieces of image information in the K display areas A high in priority representing the orders of displaying the predetermined image information so as to correspond one-to-one to each other out of the N display areas A provided to the display image. The second determination section 73 determines whether or not the change from the input state to the non-input state of the image information has occurred in one input interface 21 corresponding to the display area A having the j-th priority out of the K display areas A. Then, when the determination result by the second determination section 73 is affirmative, the display control section 71 displays the one or more images to be displayed in the one or more display areas A having the j+1-th through K-th priorities so as to correspond one-to-one to each other in the one or more display areas A having the j-th through K−1-th priorities so as to correspond one-to-one to each other. Further, the display control section 71 displays the identification image corresponding to the one input interface having already been determined by the second determination section 73 that the change to the non-input state has occurred in one of the one or more display areas A having the K-th through N-th priorities. Therefore, according to the display device 10 related to the present embodiment, it is possible for the user of the display device 10 to easily figure out the input interface 21 the input to which has the most recently stopped.

4. Other Embodiments

It is also possible to arbitrarily combine any of the following modifications with the embodiment described above.

(1) Although the embodiment described above is an application example of the present disclosure to the projector, the present disclosure can also be applied to a display device having a liquid crystal display as the display section 40 such as a portable information terminal such as a portable video game player, a smartphone, or a tablet terminal, a television receiver, or a car navigation system. In essence, as long as the display device has the display section for displaying a display image on the display surface and the N input interfaces for inputting image information representing the image to be displayed on the display surface, the present disclosure can be applied to the display device.

Figure 11:
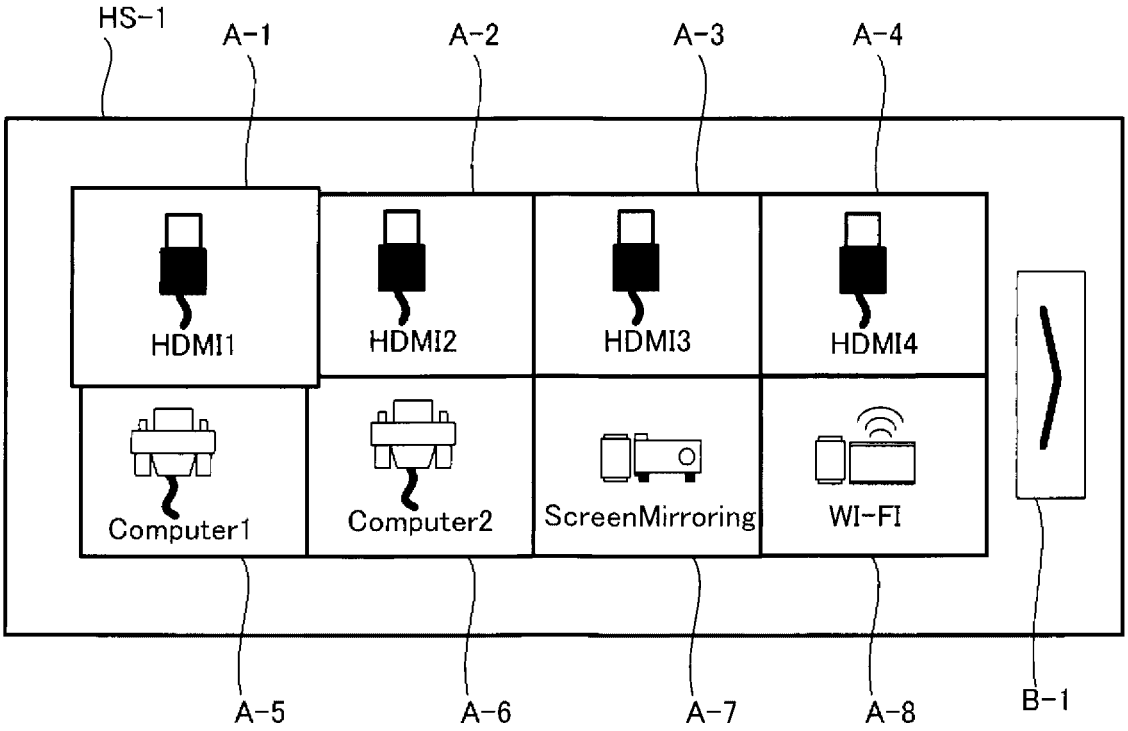
FIG. 11 is a diagram showing an example of an image of a first page of the home screen to be displayed by a display device according to Modified Example (2).
Figure 12:
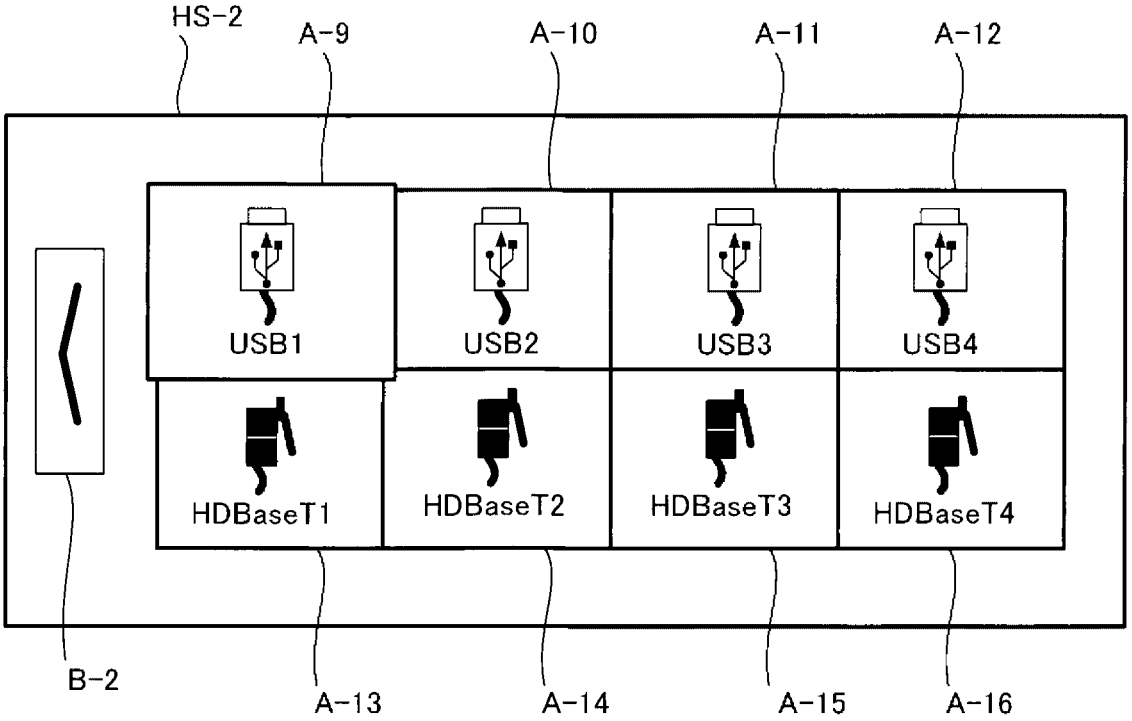
FIG. 12 is a diagram showing an example of an image of a second page of the home screen to be displayed by the display device according to Modified Example (2).

(2) It is also possible to divide the display image in the home screen into an image in a first page and an image in a second page in accordance with the number N of the input interfaces 21 provided to the display device 10, dispose M ($1 \leq M < N$) display areas A in the descending order of the priority out of the N display areas A in the image in the first page while disposing the remaining N-M display areas A in the image in the second page, and make the display section 40 display the display image page by page. FIG. 11 and FIG. 12 are diagrams showing an example of dividing the home screen HS when N=16 and M=8 are assumed. FIG. 11 is a diagram showing an example of the image HS-1 in the first page of the home screen HS, and FIG. 12 is a diagram showing an example of the image HS-2 in the second page of the home screen HS. As shown in FIG. 11, the display areas A-1 through A-8 are disposed in the image HS-1 in the first page, and as shown in FIG. 12, the display areas A-9 through A-16 are disposed in the image HS-2 in the second page. It should be noted that a virtual operator B-1 in FIG. 11 is a virtual operator for allowing the user to instruct page switching to the second page, and a virtual operator B-2 in FIG. 12 is a virtual operator for allowing the user to instruct page switching to the first page.

According to this aspect, there is no need to reduce the size of the display area A in accordance with the increase in N, and it is possible to avoid deterioration in visibility of the home screen. In the aspect in which the display image in the home screen is divided into the image in the first page and the image in the second page as described above, when the determination result by the first determination section 72 is affirmative in the state in which the display section 40 is made to display the image in the page where the display area A having already been identified by the identification section 74 is not disposed out of the image in the first page and the image in the second page, it is preferable to make the display section 40 display the image in the page where that display area A is disposed. This is because it is possible to make the user figure out the image which has the most recently started to be input without requiring the user to perform a page switching operation.

(3) It is also possible to arrange that when the operation of designating one or any one of the plural identification images has been performed by the user under the circumstance in which the identification images are displayed in one or more of the N display areas A provided to the home screen HS, the display section 40 or the terminal device 100 is made to display a guide screen for guiding how to couple an external device to the input interface 21 represented by the identification image thus designated.

(4) Each of the display control section 71, the first determination section 72, the second determination section 73, and the identification section 74 in the embodiment described above is a software module realized by the computer along the control program P1 as the software. However, it is also possible to realize each of the display control section 71, the first determination section 72, the second determination section 73, and the identification section 74 with hardware such as an ASIC, and configure the display device 10 by combining the hardware, the I/F section 20, the image processing section 30, the display section 40, and the storage section 50 with each other.

(5) It is also possible to make the control section 70 perform the following home screen information update process instead of the home screen information update process SA130. Firstly, the home screen information D2 in the volatile storage section is updated so that the image based on the image information input to the input interface 21 which has been determined in the determination process SA110 that the change from the non-input state to the input state has occurred is displayed in the display area A which has already been identified in the identification process SA120. In addition, the home screen information D2 in the volatile storage section is updated so that the identification image having been displayed in the display area A having already been identified as described above is displayed in the display area A where the identification image representing that input interface 21 has been displayed. This is because the same advantages as in the embodiment described above can be obtained even in this aspect.

(6) In the embodiment described above, the control program P1 for making the control section 70 function as the display control section 71, the first determination section 72, the second determination section 73, and the identification section 74 is stored in the storage section 50 in advance. However, it is also possible to manufacture and distribute the program alone for making a general computer function as the display control section 71, the first determination section 72, the second determination section 73, and the identification section 74. This is because by operating a computer in an existing display device along the program, it becomes possible to make the existing display device function as the display device 10. It should be noted that as a specific method of distributing the program described above, there can be cited an aspect of writing the program described above in a computer readable recording medium such as a flash ROM (Read Only Memory) to distribute the recording medium, and an aspect of distributing the program by downloading the program through a telecommunication line such as the Internet.

What is claimed is:

1. A method of controlling a display device provided with N input interfaces configured to input image information, N being an integer not smaller than 2, and a display section configured to display a display image on a display surface, the method comprising:

making the display section display N identification images used to identify each of the N input interfaces in N display areas disposed in the display image so as to correspond one-to-one to each other in a state in which the image information is not input to any of the N input interfaces;

determining whether or not a change from the state in which the image information is not input to one of the N input interfaces to a state in which the image information is input to the one of the N input interfaces occurred;

identifying one display area highest in priority from one or more display areas where the identification images are currently displayed out of the N display areas in accordance with the priority representing an order of displaying the image information determined in advance to the N display areas when a result of the determination is affirmative;

making the display section display an image based on the image information input to the one input interface in the one display area when the result of the determination is affirmative; and making the display section display the one or more identification images in the one or more display areas lower in priority than the one display area so as to correspond one-to-one to each other when the result of the determination is affirmative, wherein the one or more identification images correspond one-to-one to the one or more input interfaces to which the image information is not input, the display image includes an image in a first page and an image in a second page, and M display areas, $1 \leq M < N$, in a descending order of the priority out of the N display areas are disposed in the image in the first page, the remaining N-M display areas are disposed in the image in the second page, and the display section is made to display the display image page by page.

2. The method of controlling the display device according to claim 1, wherein the N input interfaces correspond to a first through N-th input interfaces, and the display section is made to display the one or more identification images in an ascending order of a number of the one or more input interfaces to which the image information is not input in the one or more display areas lower in priority than the one display area so as to correspond one-to-one to each other in a descending order of the priority.

3. The method of controlling the display device according to claim 1, wherein the N identification images are N icons corresponding one-to-one to the N input interfaces.

4. The method of controlling the display device according to claim 1, wherein when the result of the determination is affirmative in a state in which the display section is made to display the image in the page where the one display area is not disposed out of the image in the first page and the image in the second page, the display section is made to display the image in the page where the one display area is disposed.

5. A method of controlling a display device provided with N input interfaces configured to input image information, N being an integer not smaller than 2, and a display section configured to display a display image on a display surface, the method comprising:

displaying K images respectively represented by K pieces of image information, $1 \leq K \leq N$, in K display areas high in priority representing orders of displaying predetermined image information so as to correspond one-to-one to each other out of the N display areas provided to the display image in a state in which the image information is input to K input interfaces out of the N input interfaces;

determining whether or not a change from a state in which the image information is input to a state in which the image information is not input occurred in one input interface corresponding the display area having j-th, $1 \leq j < K$, priority out of the K display areas;

displaying one or more images to be displayed in one or more display areas having the j+1-th through K-th priorities so as to correspond one-to-one to each other in one or more display areas having the j-th through K-1-th priorities so as to correspond one-to-one to each other when a result of the determination is affirmative; and displaying an identification image corresponding to the one input interface in one or more display areas having the K-th through N-th priorities when the result of the determination is affirmative, wherein the display image includes an image in a first page and an image in a second page, and M display areas, $1 \leq M < N$, in a descending order of the priority out of the N display areas are disposed in the image in the first page, the remaining N-M display areas are disposed in the image in the second page, and the display section is made to display the display image page by page.

6. A display device comprising:

a display section configured to display a display image on a display surface;

N input interfaces configured to input image information, N being an integer not smaller than 2, representing an image to be displayed on the display surface;

a display control section configured to make the display section display N identification images used to identify each of the N input interfaces in N display areas disposed in the display image so as to correspond one-to-one to each other in a state in which the image information is not input to any of the N input interfaces;

a determination section configured to determine whether or not a change from the state in which the image information is not input to one of the N input interfaces to a state in which the image information is input to the one of the N input interfaces occurred; and an identification section configured to identify one display area highest in priority from one or more display areas where the identification images are currently displayed out of the N display areas in accordance with the priority representing an order of displaying the image information determined in advance to the N display areas when a result of the determination by the determination section is affirmative, wherein the display control section makes the display section display the image based on the image information input to the one input interface in the one display area, and the one or more identification images in the one or more display areas lower in priority than the one display area so as to correspond one-to-one to each other, the one or more identification images correspond one-to-one to the one or more input interfaces to which the image information is not input, the display image includes an image in a first page and an image in a second page, and M display areas, $1 \leq M < N$, in a descending order of the priority out of the N display areas are disposed in the image in the first page, the remaining N-M display areas are disposed in the image in the second page, and the display section is made to display the display image page by page.

* * * * *